US008950585B2

(12) United States Patent
Biswadeep

(10) Patent No.: US 8,950,585 B2
(45) Date of Patent: Feb. 10, 2015

(54) SCREEN PANEL WITH IMPROVED SCREENING AREA

(75) Inventor: Paul Biswadeep, Kolkata (IN)

(73) Assignee: Tega Industries Limited, Kolkata (IN)

( * ) Notice: Subject to any disclaimer, the term of this patent is extended or adjusted under 35 U.S.C. 154(b) by 0 days.

(21) Appl. No.: 14/003,594

(22) PCT Filed: Mar. 6, 2012

(86) PCT No.: PCT/IN2012/000158

§ 371 (c)(1),
(2), (4) Date: Oct. 9, 2013

(87) PCT Pub. No.: WO2012/120542

PCT Pub. Date: Sep. 13, 2012

(65) Prior Publication Data

US 2014/0124416 A1 May 8, 2014

(30) Foreign Application Priority Data

Mar. 8, 2011 (IN) ..... 300/KOL/2011

(51) Int. Cl.
*B07B 1/49* (2006.01)
*B07B 1/46* (2006.01)

(52) U.S. Cl.
CPC ..... *B07B 1/46* (2013.01); *B07B 1/4645* (2013.01)
USPC ..... 209/392; 209/397; 209/405; 209/412

(58) Field of Classification Search
USPC ..... 209/392, 393, 395, 397, 405, 412
See application file for complete search history.

(56) References Cited

FOREIGN PATENT DOCUMENTS

| | | | |
|---|---|---|---|
| AU | 501192 | B2 | 6/1979 |
| AU | 556953 | B2 | 11/1986 |
| DE | 3621091 | A1 * | 2/1987 |
| DE | 8712708 | U1 | 11/1987 |
| DE | 3637113 | A1 * | 5/1988 |
| FR | 2634148 | A3 * | 11/1990 |
| GB | 1451573 | A | 10/1976 |
| WO | WO9005594 | A1 * | 5/1990 |
| WO | WO-2007105227 | A1 | 9/2007 |

OTHER PUBLICATIONS

PCT International Search Report mailed Dec. 4, 2012 issued in corresponding International Patent Application No. PCT/IN2012/000158.

* cited by examiner

*Primary Examiner* — David H Bollinger
(74) *Attorney, Agent, or Firm* — Edwards Wildman Palmer LLP; Christopher J. Cillie; Joshua L. Jones

(57) ABSTRACT

A screen panel for mining and quarrying industries adapted to be mounted on a screen deck including at least a screening portion having one or more rider bars and a bottom reinforcement portion, the screen panel being designed such that the rider bars are adapted to be replaced from the screening portion as and when required. The rider bars are attached to a portion of the screening portion and/or the reinforcement portion by button type snug fitting.

20 Claims, 2 Drawing Sheets

SCREEN PANEL WITH IMPROVED SCREENING AREA

CROSS-REFERENCE TO RELATED APPLICATIONS

This application is the national phase under 35 U.S.C. §371 of PCT International Application No. PCT/IN2012/000158, filed Mar. 6, 2012, which claims priority to Indian Patent Application No. 300/KOL/2011 filed Mar. 8, 2011, the entire contents of each aforementioned application is incorporated herein by reference.

FIELD OF THE INVENTION

The present invention in general relates to screening panel for screening/separating or grading of minerals in the mining and quarrying industries and in particular to screen panels equipped with replaceable rider bar portion.

BACKGROUND OF THE INVENTION

Screening panel system for ore screening decks that is now widely used by the mining industry, replaced the earlier screening cloths and large wire screening frames. These screening panels are known to be either of Rubber or Polyurethane with steel reinforcements. It is also known that such panels are manufactured by hot vulcanized method or casting. The panels are adapted to be secured with the support frame of the screen machine by bolting. The panels may also be secured to the frame with an alternate method using a pin and separate lug arrangement.

A difficulty encountered in using the panels in vogue is that during screening operation, lump or big particles cause substantial impact on these panels. Consequently, the panels get worn out at a faster rate. To be precise, the screening portion gets damaged away due to constant use and consequent wear and tear, rendering the entire screen panel unfit for use after a certain period of operation. Also, due to low screening efficiency, the stratification achieved in the screened material is low.

Accordingly, there exists a long felt need to design improved screen panels for its application in mining and quarrying industries, which have replaceable portions in the screening portion, so that the longevity of the screen panel is substantially improved and simultaneously, the screening efficiency is improved.

The present invention meets the aforesaid long felt need.

All through out the specification including the claims, the words "screen panel", "mining", "quarrying", "mineral", "ores", "abrasion resistant", "wear resistant", "rider bar", "reinforcement portion", are to be interpreted in the broadest sense of the respective terms and includes all similar items in the field known by other terms, as may be clear to persons skilled in the art. Restriction/limitation, if any, referred to in the specification, is solely by way of example and understanding the present invention.

OBJECTS OF THE INVENTION

It is the principal object of the present invention to provide a screen panel having a screening portion with replaceable rider bars for its application in mining and quarrying industries.

It is a further object of the present invention to provide a screen panel having higher longevity and which is flexible.

It is a further object of the present invention to provide a screen panel adapted to provide improved stratification in the screened material.

It is yet another object of the present invention to provide a screen panel which has a substantially low cost of manufacturing and operation.

How the foregoing objects are achieved and the other aspects of the present invention, will be clear from the following description which is purely by way of understanding and not by way of any sort of limitation.

SUMMARY OF THE INVENTION

Accordingly, the present invention provides a screen panel for mining and quarrying industries adapted to be mounted on a screen deck including at least a screening portion having one or more rider bars and a bottom reinforcement portion, said screen panel being designed such that said rider bar(s) is(are) adapted to be replaced from said screening portion as and when required.

In accordance with preferred embodiments of the screen panel of the present invention:

- said screening portion of said screen panel has abrasion resistant apertures having a flaring design and said screen panel is adapted to provide improved stratification;
- said screening portion having one or more rider bars and said reinforcement zone are adapted to be configured as a plurality of modular units;
- said rider bars are attached to a portion of said screening portion and/or said reinforcement portion by button type snug fitting or by pin and lug arrangement or by bolting or by any slot;
- said rider bars are made up of polyurethane/rubber/steel and said reinforcement section is a frame made by hot vulcanizing or casting with rubber or polyurethane;
- the screening surface of said panel is made of any one of or a combination of mild steel, stainless steel, rubber and/or polyurethane with or without steel reinforcing;
- the reinforcement portion of said panel is fitted to the machine frame by button type snug fitting or by pin and lug arrangement or by bolting.

The present invention also provides a method of manufacturing a screen panel for mining and quarrying industries adapted to be mounted on a screen deck, including designing a screening portion, and at least a bottom reinforcement portion, detachably attaching one or more rider bars to lie on said screening portion in the manner such as herein described and attaching said screening portion and said reinforcement section such that said rider bars can be replaced as and when required.

The present invention also provides a screening deck for mining and quarrying industries, having mounted thereon a plurality of screen panels, each said panel at least a screening portion having one or more rider bars and a bottom reinforcement portion, said screen panel being designed such that said rider bar(s) is(are) adapted to be replaced from said screening portion as and when required.

BRIEF DESCRIPTION OF THE ACCOMPANYING DRAWINGS

The nature and scope of the present invention, will be better understood from the accompanying drawings, which are by way of illustration of some preferred embodiments and not by way of any sort of limitation. In the accompanying drawings, FIG. 1 illustrates a plan view of the screening surface in accordance with a preferred embodiment of the present invention.

DETAILED DESCRIPTION OF THE INVENTION

The following describes a preferred embodiment of the present invention, which are purely for the sake of understanding the performance of the invention, and not by way of any sort of limitation.

Principally, the present invention aims to providing a screening device for screening mineral ores, which improves the screening efficiency by improving stratification as well as prevents wear of the panels. Thus, the life of the panels is increased. This is done by designing screen panels having screening portions with replacable rider bars. This technology, improves the screening efficiency to a great extent and at the same time, it prevents wear considerably with the help of its unique rider bar design. The polyurethane/Rubber, helps to take the impact of the materials coming in contact with the screening surface, whereas the apertures prevent clogging, due to its flaring type design (not shown). In the event of substantial wearing of the rider bars, those can be replaced with fresh ones, thus eliminating the need for replacing the entire screening portion, or for that matter the entire screening panel.

The present invention, prevents the wear considerably by protecting the modular panels and enhances the screening efficiency, due to the presence of replaceable rider bars. This in turn improves the stratification in the screened material.

Figure 1:
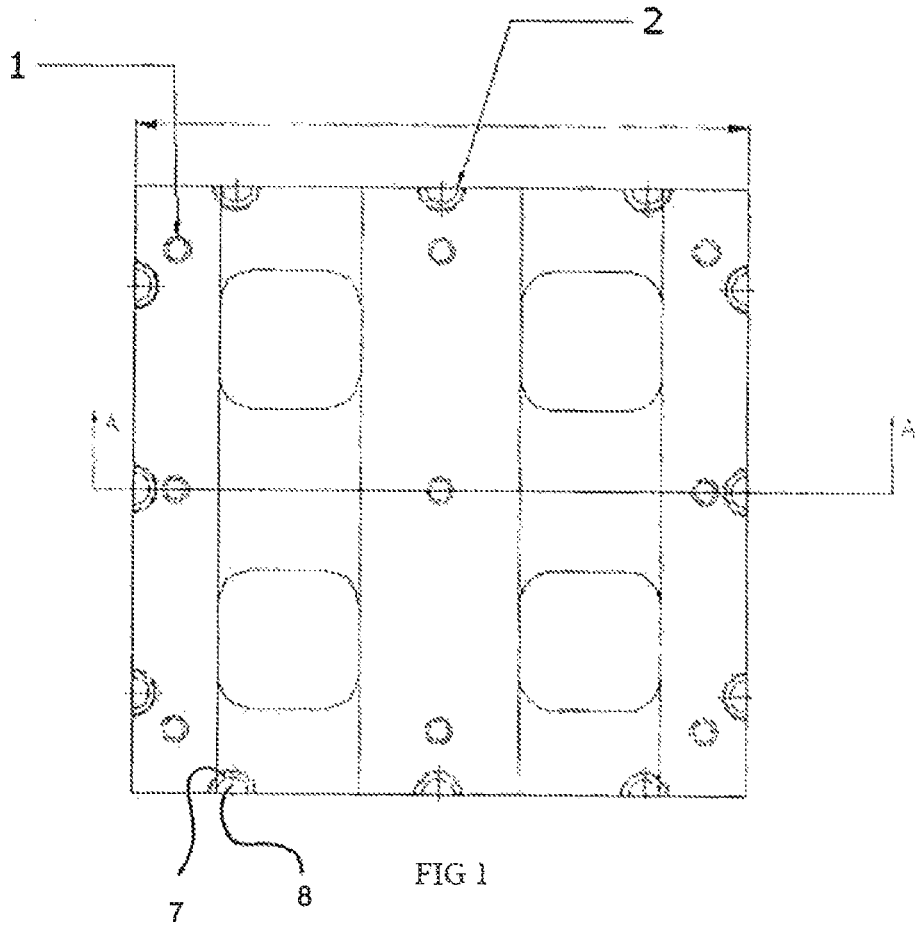

The panel is manufactured by hot vulcanizing or casting with rubber or polyurethane, having externally reinforced/supported with the panel fixing frame under the edge surface of the panel. The panels have button fixing slots, in the screening portion (5), into which button type rider bars, i.e. replaceable rider bars are fixed, say for example, simply by press fit. The accompanying FIG. 1 illustrates the screening surface of a preferred embodiment of the screen panel, according to the present invention. It shows the slot (1) for button type fixing of the rider bars (3), best shown in the accompanying FIGS. 2 and 3. The accompanying FIG. 1 also shows the screen panel (2) fitted to the frame through lugs (7) and pins (8).

Figure 2:
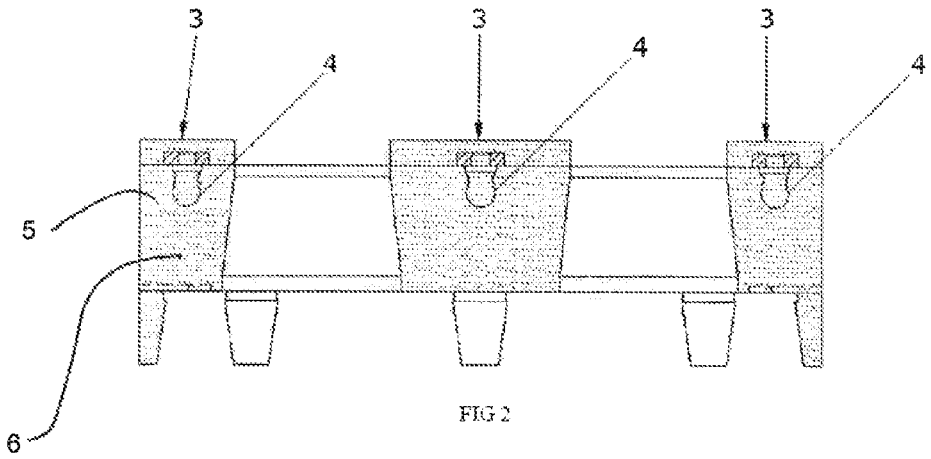
FIG. 2 illustrates a sectional view of the screening surface in FIG. 1 along the line A-A.
Figure 3:
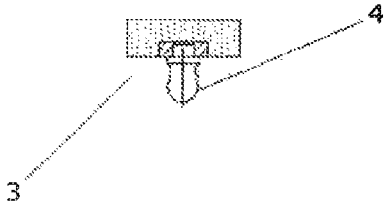
FIG. 3 illustrates an enlarged plan view of a preferred embodiment of the rider bar, according to a preferred embodiment of the present invention.

In the above context, it is hereby clarified that the screen panel (2), the reinforcement portion (6) to be precise, may be fitted to the frame by button type, bolting type, pin and lug type or by any other suitable technique, as would be known to persons skilled in the art and the present invention also encompasses all such techniques. This is true also for the fitting arrangement of the rider bars (3) on the screening portion of the panel as well. The accompanying FIGS. 2 and 3 show only one such technique. Alternatively, the rider bars may be fitted in the reinforcement portion also in the same manner, ensuring that the majority of it lies in the screening portion (5).

Now coming to the accompanying FIG. 2, it shows how the rider bars 3 have preferably a button type fixing (4). This would be further clear from the accompanying FIG. 3, where the like reference numerals, represent like features. The screening portion of the panel has a slot (1) [illustrated in FIG. 1], into which the protrusion (4) is detachably attached by snug fitting. This slot, alternatively may be in the reinforcement portion as well, but in that event, rider bars have to be fitted therein, ensuring that the majority of it lies in the screening portion.

Since lump size particles do not come to the contact of main screening zone (or comes very less), the whole screening zone or the panel need not to be replaced. Just replacing the rider bars in the screening zone will do. There is no need to replace the entire screen panel or for that matter the entire screening zone. This facilitates ensuring higher longevity of the screen panels and, simultaneously, ensures low cost of operation. Thus, the rider bars prolong the life of the screening elements and also reduce the cost of operation.

Further, the rider bars ensure enhancement of stratification in the screened material and thus the screening efficiency is increased as will be understood to persons skilled in the art. In particular, this is achieved by replacing the damaged rider bars from time to time so that the material to be screened is indeed screened, rigorously, according to the grain size, so that no clogging or defective/erroneous screening takes place. Hence, improved stratification is achieved.

The screen panels are preferably standard modular type, i.e—305×305 or 300×300 or 610×300 or similar will have all the advantages of modular panels, i.e—easy to handle, down time is much less compared to existing panels for similar application. Further the panels can be of any size starting from the standard modular sizes. Rider bars are easily replacable when they get worn out, as stated before. Hence, by changing only the rider bars the screen can be used for a considerable period of time and without changing the whole screen panels. This renders the screen panels economic as well. This technology is applicable to both rubber and polyurethane panels.

Ideally, the screening surface is made of any one of or a combination of mild steel, stainless steel, rubber and/or polyurethane with or without steel reinforcing.

The comprehensive panel preferably comprises of vulcanized material, rubber polyurethane, having embedded within it steel reinforcing bars, at the outer edges of said panel and extended across the inner area of said panel, thereby providing support to said screening surface.

Further the fixing of replaceable rider bars may be done by the button type snug fitting applying the fixing means, as protected by Indian Patent No. 231,453 of the applicant. As explained before, other types of fixing arrangements are also embraced by the present invention. For example, instead of a snug fitting type arrangement, there may be a pin and lug type fixing arrangement for fixing the two portions of the panel and for fitting the panel on to the machine frame. Alternatively, there may be a bolt type of fixing arrangement.

The method of manufacturing a screen panel according to the present invention includes designing a screening portion, and at least a bottom reinforcement portion, detachably attaching one or more rider bars to lie on said screening portion in the manner such as herein described and attaching said screening portion and said reinforcement section such that said rider bars can be replaced, from said screening portion as and when required.

The present invention has been described with reference to some drawings and preferred embodiments, purely for the sake of understanding and not by way of any limitation and the present invention includes all legitimate developments within the scope of what has been described hereinbefore and claimed in the appended claims.

I claim:

1. A screen panel for mining and quarrying industries adapted to be mounted on a screen deck including at least a screening portion having one or more rider bars and a bottom reinforcement portion, said screen panel being configured such that said rider bar is adapted to be replaced from said screening portion as and when required, wherein said screening portion defines a screening surface with a material aperture extending through said screen panel, wherein said rider bar overlays said screening surface and aligns to an edge of said material aperture.

2. The screen panel as recited in claim 1, wherein said material aperture has a flared profile widening from said screening surface.

3. The screen panel as recited in claim 1, wherein said screening portion, said reinforcement portion, and said rider bar form an integral screen panel module configured for removal from a screen deck as an assembly.

4. The screen panel as recited in claim 1, wherein said rider bars include a button type snug fitting coupling said rider bar to said screening surface of said screen panel.

5. The screen panel as recited in 1, wherein said rider bar includes any one or a combination of polyurethane, rubber, and steel, wherein said reinforcement portion is a frame made by hot vulcanizing or casting with rubber or polyurethane.

6. The screen panel as recited in claim 1, wherein the screening portion of said screen panel includes any one of or a combination of mild steel, stainless steel, rubber and/or polyurethane with or without steel reinforcing.

7. The screen panel as recited in claim 1, wherein said screen panel is configured for fitting to a machine frame by a button type snug fitting or by pin and lug arrangement.

8. The screen panel as recited in claim 1, wherein the screen panel has a standard modular size.

9. The screen panel as recited in claim 1, wherein a sidewall of said rider bar extends vertically from said aperture edge relative to said screening surface.

10. The screen panel as recited in claim 1, wherein said material aperture is a first material aperture, and further including a second material aperture extending through said screen panel, wherein said rider bar spans a portion of said screening surface disposed between said first and second material apertures.

11. The screen panel as recited in claim 10, wherein opposed side walls of said rider bar are aligned with adjacent edges of said first and second material apertures.

12. The screen panel as recited in claim 11, wherein said opposed sides walls extend vertically from said adjacent aperture edges relative to said screening surface.

13. The screen panel as recited in claim 1, wherein said rider bar includes first and second opposed side walls, said first side wall overlaying an edge of said material aperture, said second lateral edge overlaying an outer edge of said screen panel.

14. The screen panel as recited in claim 13, wherein said rider bar overlays first and second fastener slots defined within said screening portion, said first fastener slot being bounded by said edge of said screen panel, said second fastener slot being circumferentially bounded by said screening portion of said screen panel.

15. The screen panel as recited in claim 14, wherein said rider bar includes a protrusion coupled to an underside of said rider bar, said protrusion being received within said second fastener slot.

16. The screen panel as recited in claim 15, wherein said protrusion includes a button type snug fitting.

17. The screen panel as recited in claim 14, wherein said rider bar includes a steel reinforcing element, said protrusion being coupled to said steel reinforcing element.

18. The screen panel as recited in claim 8, wherein said standard modular size is 300 millimeters by 300 millimeters, 305 millimeters by 305 millimeters, or 610 millimeters by 300 millimeters.

19. A method of manufacturing a screen panel for mining and quarrying industries adapted to be mounted on a screen deck, including:

providing a screening portion and at least a bottom reinforcement portion;

detachably attaching a rider bar to lie on said screening portion; and attaching said screening portion and said reinforcement portion such that said rider bar can be replaced as and when required, wherein said screening portion defines a screening surface with a material aperture extending through said screen panel, wherein attaching said rider bar includes overlaying over said screening surface such that said rider bar aligns with an edge of said material aperture.

20. A screening deck for mining and quarrying industries, having mounted thereon a plurality of screen panels, each said screen panel at least a screening portion having one or more rider bars and a bottom reinforcement portion, said screen panel being configured and adapted such that said one or more rider bars can be replaced from said screening portion as and when required, wherein said screening portion defines a screening surface with a material aperture extending through said screen panel, wherein said rider bar overlays said screening surface and aligns with an edge of said material aperture.

* * * * *